United States Patent [19]

Taylor

[11] 4,244,417

[45] Jan. 13, 1981

[54] FLEXIBLE DOOR WIPER SEAL

[75] Inventor: Robert B. Taylor, Findlay, Ohio

[73] Assignee: R. L. Kuss & Co., Inc., Findlay, Ohio

[21] Appl. No.: 792,587

[22] Filed: May 2, 1977

[51] Int. Cl.[3] ..... A47G 5/02
[52] U.S. Cl. ..... 160/243
[58] Field of Search ..... 160/243, 392, 395; 49/499

[56] References Cited

U.S. PATENT DOCUMENTS

| | | | |
|---|---|---|---|
| 2,718,677 | 9/1955 | Cornell | 49/499 |
| 3,118,192 | 1/1964 | West | 49/499 |
| 3,355,851 | 12/1967 | Imbertson et al. | 160/395 |
| 3,398,779 | 8/1968 | Kuss | 160/243 |
| 3,704,742 | 12/1972 | Kuss | 160/243 |

FOREIGN PATENT DOCUMENTS

| | | | |
|---|---|---|---|
| 1267642 | 5/1968 | Fed. Rep. of Germany | 160/243 |

*Primary Examiner*—Peter M. Caun
*Attorney, Agent, or Firm*—Wilson, Fraser, Barker & Clemens

[57] ABSTRACT

This invention relates to a sealing device for flexible closures for building openings, especially aircraft hangars, gymnasiums, etc. The device comprises elongate flexible sealing gaskets located alongside and substantially coextensive with each of the vertical building members on each side of the opening. The gaskets decline inwardly toward one another and each has a convex outer surface, which is skewed outwardly from the opening. The gaskets contact the flexible door along its vertical edges to seal it when closed and assist in preventing wrinkles or uneven winding of the flexible door on its roller.

8 Claims, 3 Drawing Figures

FLEXIBLE DOOR WIPER SEAL

BACKGROUND OF THE INVENTION

Due to developments in the last one to two decades in flexible fabrics, such as nylon, dacron, etc., it has become possible to fabricate flexible doors for very large openings such as aircraft hanger doors. These doors typically include a flexible curtain secured at its top to an overhead member and a roller secured generally at the bottom of the curtain with a means for raising and lowering the door by winding or unwinding it upon the roller. Such a door is disclosed in commonly owned U.S. Pat. No. 3,398,779. Such doors if properly constructed have the requisite strength to withstand wind forces, are resistant to damage, and yet require relatively little storage space when in an upper rolled position. Although such a flexible door in its closed position will withstand high wind pressures, the lack of a good seal, in addition to slackness of the curtain, causes substantial air leakage, undesirable flapping and permits the possibility of unwanted entry. The leakage and flapping is caused by the tendency of the flexible door to billow under strong wind pressures.

Other sealing means have been developed for flexible doors such as disclosed in commonly owned U.S. Pat. No. 3,704,742. However, the sealing means disclosed therein does not assist in the elimination of wrinkles on the roller when it is wound thereon and also may permit slack when unwound. As a result, especially with the larger doors, wind acts upon the curtain slack in causing flapping which still results in breakage of the seal in some cases, and decreases the useful life of the curtain by facilitating stretch and tear.

SUMMARY OF THE INVENTION

The present invention comprises a sealing device which helps to eliminate the slack in flexible doors so as to prevent billowing under wind pressures and to prevent wrinkles from being wound on the roller. The sealing device comprises elongate flexible sealing gaskets extending alongside and substantially coextensive with each of the vertical building members on each side of the opening. The gaskets each have a convex outer surface facing the flexible door and, when properly installed each decline inwardly toward one another such that when the roller is in its lower position, the curtain contacts the gaskets along the vertical height thereof along upwardly diverging lines of contact. The convex outer surface of the sealing gaskets is skewed outwardly from the opening which, along with the diverging lines of contact, results in a force being applied to the curtain in a downward and outward coplanar direction.

It is therefore an object of the present invention to provide a sealing device for flexible closures for building openings which eliminates the slack in the closure and helps to prevent wrinkles from being formed on the roller.

It is a further object of the invention to extend the useful life of the curtain membrane.

It is still further an object of the invention to eliminate air leakage along the sides of such flexible closures.

Other objects and advantages of this invention will be apparent to those skilled in the art from the following detailed description of a preferred embodiment and best mode thereof.

DETAILED DESCRIPTION

Figure 1:
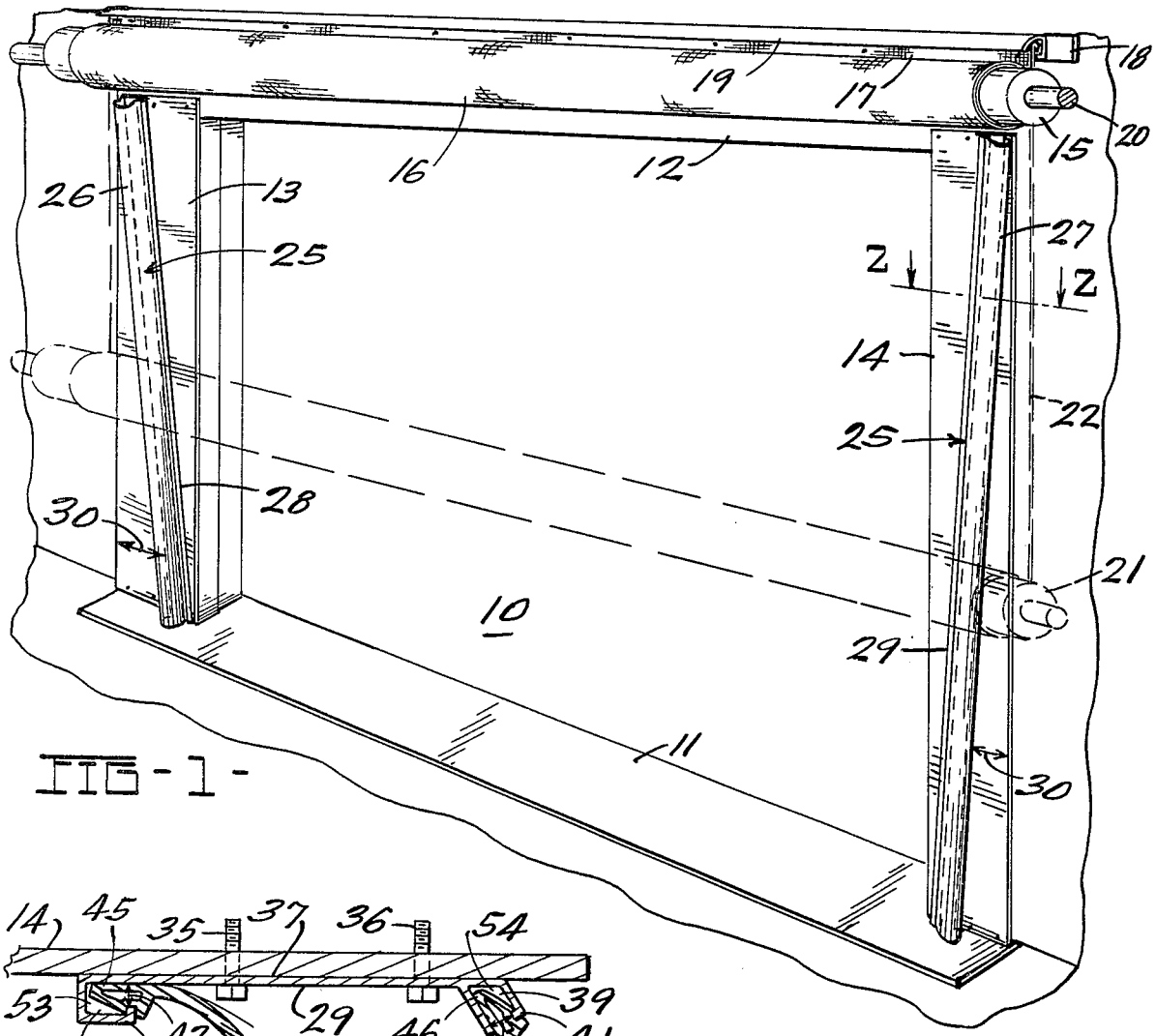
FIG. 1 is a perspective view of an embodiment of the sealing device of this invention, as it is seen from the inside of a building, such as an aircraft hangar.

FIG. 1 illustrates a large building opening 10 surrounded by floor member 11, horizontal building member 12, and vertical side members 13 and 14. A substantially horizontal roller 15 extends across said opening 10 and has a membrane 16 made from flexible material such as nylon, dacron, etc., wound and secured thereon. The upper end 17 of the membrane 16 is secured to beam 18 and horizontal building member 12 by means of attachment device 19. The central shaft 20 of the roller 15 is in operative engagement with a motor or hand crank (not shown), so that the roller 15 may be lowered and the membrane 16 unwound therefrom. The roller and membrane in the half-lowered position are shown in FIG. 1 by the dashed lines at numerals 21 and 22 respectively. Such a roller and its operation are described in more detail in U.S. Pat. No. 3,398,779.

A preferred embodiment of the sealing device of the present invention, indicated generally by the numeral 25, comprises elongated flexible gaskets 26, 27 preferably made from rubber or other flexible sealing material, and brackets 28, 29 preferably made from light metal such as extruded aluminum, affixed to vertical side members 13, 14 respectively so as to decline inwardly toward each other at an angle 30 from the vertical. It has been found that a preferred angle is roughly 1.5 degrees, or a rate of decline of four inches per twelve feet of gasket.

Figure 2:
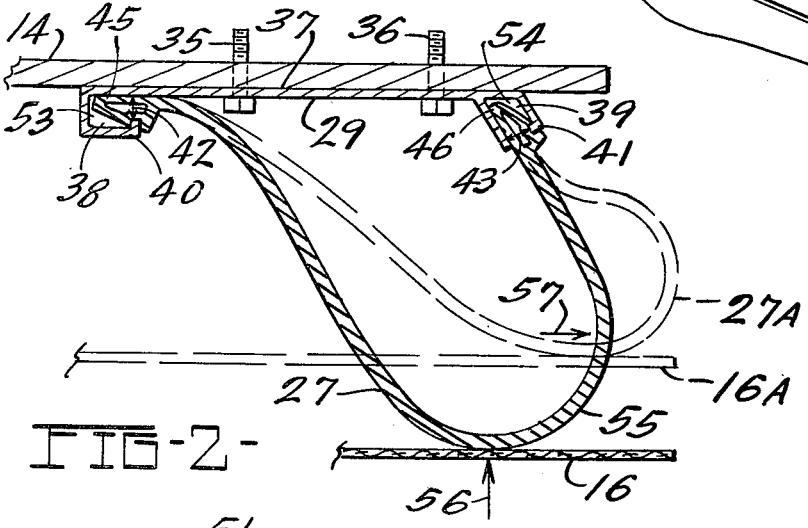
FIG. 2 is a cross-sectional view of the sealing gasket and support member along the line 2—2 of FIG. 1.
Figure 3:
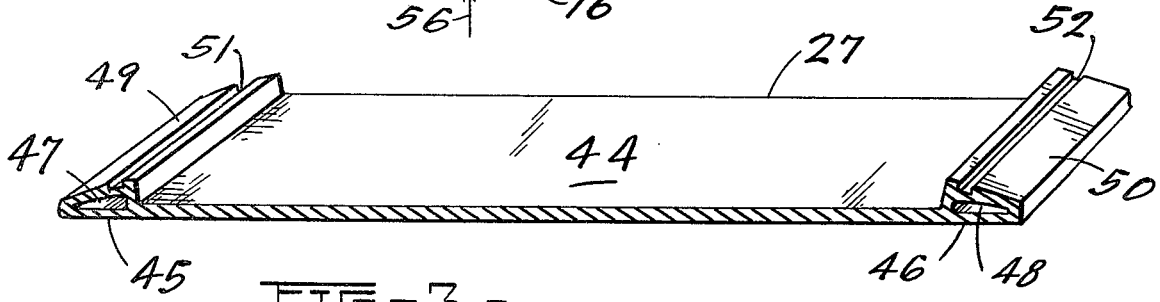
FIG. 3 is a cross-sectional view of an embodiment of the sealing gasket of this invention in the flat position.

FIGS. 2 and 3 show the gasket 27 and bracket 29 in more detail. The bracket 29 is fastened to the vertical side member 14 by means of bolts 35, 36. The bracket 29 itself comprises plate 37 and generally rectangular slots 38,39. The slots 38 and 39 include flanges 40, 41 and openings 42, 43 respectively. Opening 42 is perpendicular to the plate 37 and opening 43 is oblique thereto.

The gasket 27 comprises main body 44 and axially symmetric and congruent appendages 45, 46. Appendages 45, 46 each have channels 47, 48, inclined faces 49, 50, and grooves 51, 52. The gasket 27 and bracket 29 are joined by sliding appendages 45, 46 through slots 38, 39 respectively such that flanges 40, 41 engage the respective grooves 51, 52. The inclined faces 49, 50 allow the appendages 45, 46 to be inserted without binding against the inner surfaces 53, 54 of the slots 38, 39. Since the gasket 27 is made from rubber or other flexible sealing material, the channels 47, 48 provide a spring-type compressive force against flanges 40, 41 to aid in securing the gasket 27 in place.

After insertion, the gasket 27 forms a skewed convex outer surface 55 due to the non-symmetry of the planes of openings 42 and 43 about the axis of the elongate bracket 29. When the membrane 16 presses against the gasket 27 in the direction indicated by the arrow 56, the gasket 27 deforms, as shown by the dashed line at numeral 27A, resulting in an outward stretching force against the now positioned membrane 16A as indicated by arrow 57. Since the gasket 27 declines inwardly, as shown in FIG. 1 and discussed above, the stretching force indicated by arrow 57 is not only outward but also slightly downward, thereby removing slack in the membrane 16.

Although the above-described embodiment relates to large building openings, such as for aircraft hangars and gymnasiums, it should be clear that the present invention is applicable and useful for openings of all sizes. Additionally, it should be understood that the invention applies equally well whether the roller itself moves up and down, or if it stays stationary while the membrane unwinds. In fact, no roller is even required, although in most cases one is desirable.

Still further, especially in the case of large openings or where the roller remains stationary, it may be and often times is desirable to apply a supplementary force against the membrane and sealing device to assure an air tight seal if one is desired. Such a supplementary force may be supplied by a sealing mechanism as disclosed in U.S. Pat. No. 3,704,742, or any other appropriate form of locking mechanism.

Other objects and advantages of the invention will be apparent to those skilled in the art and various modifications thereof may be made without departing from the spirit and scope of the attached claims.

What I claim is:

1. A sealing device for a flexible closure for building openings including a flexible membrane secured at its upper edge to a substantially horizontal building member above such opening and having a substantially horizontal roller extending across said opening between spaced apart vertical building members and secured to said membrane whereby rotation of said roller in one direction will raise said roller as it winds said membrane thereupon and rotation of said roller in the opposite direction will lower said roller as it unwinds said membrane therefrom, said sealing device, comprising:

elongate flexible sealing gaskets extending alongside and substantially coextensive with each of said spaced apart vertical building members, said sealing gaskets having a convex outer surface facing and flexible membrane, with said gaskets each declining inwardly toward one another and said outer surface being skewed outwardly from said opening, whereby when said roller is in its lower position, said membrane contacts said gaskets along the vertical height thereof along upwardly diverging lines of contact.

2. A sealing device, as defined in claim 1, wherein said gaskets decline inwardly at an angle of substantially 1.5 degrees from the vertical.

3. A sealing device, as defined in claim 1, including support members coextensive with each of said gaskets for mounting said gaskets thereon, said support members having a slot extending along the height of each side for receiving and securing said gaskets and said gaskets having an appendage along the height of each side for respectively engaging said slots.

4. A sealing device comprising, in combination, an elongate flexible sealing gasket having an asymmetrically offset outer surface and an appendage along the length of each side, and a support member for mounting said gasket thereon having a first slot along the length of one side disposed substantially normal to said support member and a second slot along the length of the other side disposed at an acute angle to said first slot, said slots for receiving and securing said appendages.

5. A sealing device, as defined in claim 4, whereby said slot is substantially rectangular in cross-section and said appendage is non-rectangular in cross-section such that when said appendage engages said slot at least one gap is defined therebetween.

6. A sealing device, as defined in claim 4, whereby said appendage includes a groove on at least one face thereof and said slot includes at least one flange, such that when said appendage engages said slot said grooves likewise engage said flanges.

7. A sealing device, as defined in claim 6, whereby said appendage includes a channel therethrough such that said appendage and said channel exert compressive force against said flanges when said appendage engages said slot.

8. A sealing device for a flexible closure for building openings including a flexible membrane secured at one horizontal edge to a substantially horizontal roller extending across said opening between spaced apart vertical building members, whereby rotation of said roller in one direction will wind said membrane thereupon and rotation of said roller in the opposite direction will unwind said membrane therefrom, said sealing device comprising:

elongate flexible gaskets extending alongside and substantially coextensive with each of said spaced apart building members, said sealing gaskets having a convex outer surface facing said flexible membrane, with said gaskets each declining inwardly toward one another and said outer surface being skewed outwardly from said opening, whereby when said membrane is in its lower position, said membrane contacts said gaskets along the vertical height thereof along upwardly diverging lines of contact.

* * * * *